US005984137A

United States Patent [19]

Grosjean

[11] Patent Number: 5,984,137

[45] Date of Patent: Nov. 16, 1999

[54] SHEET METAL PACKING FOR DISPOSAL MATERIALS

[75] Inventor: Maurice Grosjean, Roye, France

[73] Assignee: Ferembal, Clichy, France

[21] Appl. No.: 09/018,463

[22] Filed: Feb. 4, 1998

[30] Foreign Application Priority Data

Feb. 6, 1997 [FR] France ..... 97 01376

[51] Int. Cl.[6] ..... B65D 39/00

[52] U.S. Cl. ..... 220/789; 220/794; 220/795; 220/359.4; 220/501; 220/529

[58] Field of Search ..... 220/789, 794, 220/795, 315, 359.4, 501, 505, 529, 256

[56] References Cited

U.S. PATENT DOCUMENTS

| | | | |
|---|---|---|---|
| 2,795,348 | 6/1957 | Kunik | 220/359.4 |
| 4,446,986 | 5/1984 | Bowen et al. | 220/789 |
| 5,065,923 | 11/1991 | Hoefer et al. | 220/529 X |
| 5,080,251 | 1/1992 | Noack . | |
| 5,152,418 | 10/1992 | Kroeschell et al. | 220/359.4 |
| 5,242,077 | 9/1993 | Smith et al. | 220/529 |

FOREIGN PATENT DOCUMENTS

| | | |
|---|---|---|
| 2 669 896 | 6/1992 | France . |
| 35 36 656 | 4/1987 | Germany . |
| 92 15 802 | 1/1993 | Germany . |
| 94 04822 | 6/1994 | Germany . |
| 94 03 362 | 7/1994 | Germany . |

*Primary Examiner*—Stephen Cronin
*Attorney, Agent, or Firm*—Young & Thompson

[57] ABSTRACT

A sheet metal packing for disposable materials, comprises a container with a wall, a bottom and an opening, as well as a lid to close the opening. A partition (40) is fixed rigidly inside the container (1) and delineates, with the bottom (4) and the wall (3) of the container, a receptacle (60) for the materials, whereby at least one orifice (43) has been arranged in the partition for the passage of the materials in the receptacle.

8 Claims, 2 Drawing Sheets

SHEET METAL PACKING FOR DISPOSAL MATERIALS

BACKGROUND OF THE INVENTION

The invention relates to sheet metal packing used for packaging disposable materials, which cannot be eliminated directly together with household refuse or sewage waters.

Toxic materials or used devices, containing a risk of contamination, can be mentioned among others.

These materials must be collected specifically, which is cumbersome and relatively costly.

One such metal packing is known from document DE-U-94 03 362. This known packing is intended for disposing sharp and pointed objects such as needles, surgical sharps, and syringes. Its construction is such as to prevent specifically medical personnel from injuring themselves during the disposal procedure.

Therefore, the known packing comprises a bin formed by a base plate, a wall, and a top plate provided with an entry for the disposable material and with a device which allows separating sharp or pointed objects from the appropriate handle without touching them. The packing further comprises a lid. In this known packing, the top plate of the bin is rigidly attached to the wall by a circumferential seam or by spot welding.

Another waste disposal container is known from DE-A-35 36 656. This known container comprises a bin removably attached to a support device comprising a lid and a mechanism for opening and closing the lid. This container further comprises an insert attached to the wall of the bin and which is intended for extinguishing spontaneously inflamed material inside the bin.

It has proven necessary to develop a new system, designed for packaging materials to be eliminated, readily disposable together with the household and whose cost is minimal.

SUMMARY OF THE INVENTION

Thus, the invention relates to a sheet metal packing for disposable materials, whereas the packing system comprises a container with a wall, a bottom and an opening, as well as a lid to close the container. A partition is fixed rigidly inside the container and delineates, with the bottom and the wall of the container, a receptacle for the materials, whereby at least one orifice has been arranged in the partition for the passage of the materials in the receptacle. The container comprises a snap ring for latching the internal partition on the container.

This packing is used as follows:

The disposable materials are placed gradually in the receptacle provided inside the container, thanks to the orifice arranged in the internal partition.

When the receptacle is full, the orifice is closed by appropriate means and the container is closed definitively using the lid.

Thus, the packing can be disposed of directly with the household refuse, without any risks of contamination, since the materials placed inside the receptacle cannot come out of the container.

To limit the risks of contamination still further, means can be arranged to fasten the lid onto the container, whereby the packing cannot be opened using an ordinary tooling.

For certain disposable materials, the risks of contamination are reduced still further, when the packing is sterilized.

In such a case, the means enabling fastening the lid on the container are advantageously made of a material which is placed on the rim of the lid or at the circumference of the opening of the container and which ensures the link between the lid and the container under the effect of temperature.

This material can notably consist of a welding material, such as tin, or a thermoplastic or duroplastic glue.

The following characteristics of the invention can also be taken into consideration, separately or according to all the possible technical combinations:

- the container comprises a snap ring for latching the lid on the container
- the internal partition is more or less parallel to the bottom of the container,
- the lid comprises, on its external circumference, a skirt designed for nesting into the opening of the container,
- the lid comprises a rolled rim delineating a throat for the thermomeltable material,
- the lid comprises at least one hole and, preferably, one filter,
- the orifice arranged in the internal wall is closed by removable or retractable means.

BRIEF DESCRIPTION OF THE DRAWINGS

The invention will be understood better and other aims, advantages and characteristics of the invention will appear more clearly when reading the following description of non-restrictive embodiments, a description made with reference to the appended drawings on which

The items common to the different figures will be designated by the same references.

DETAILED DESCRIPTION OF EMBODIMENTS

Figure 2:
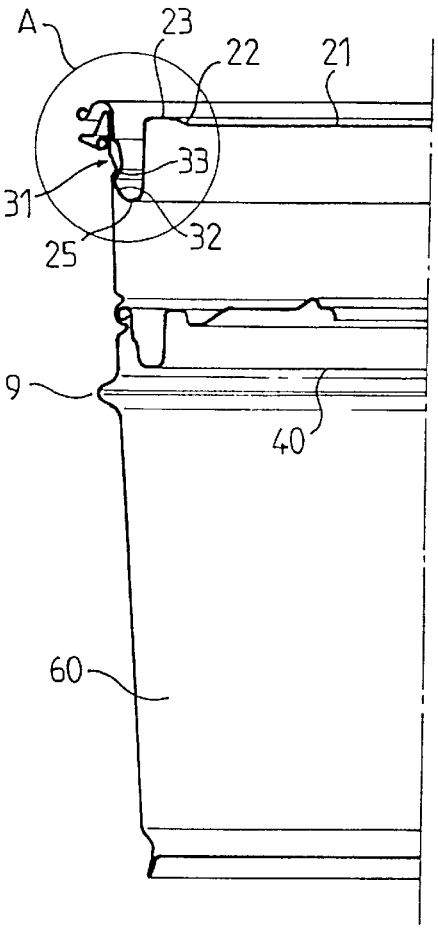
FIG. 2 represents a sectional half-view of a packing according to the invention, whereby the lid and the container are interconnected.
Figure 1:
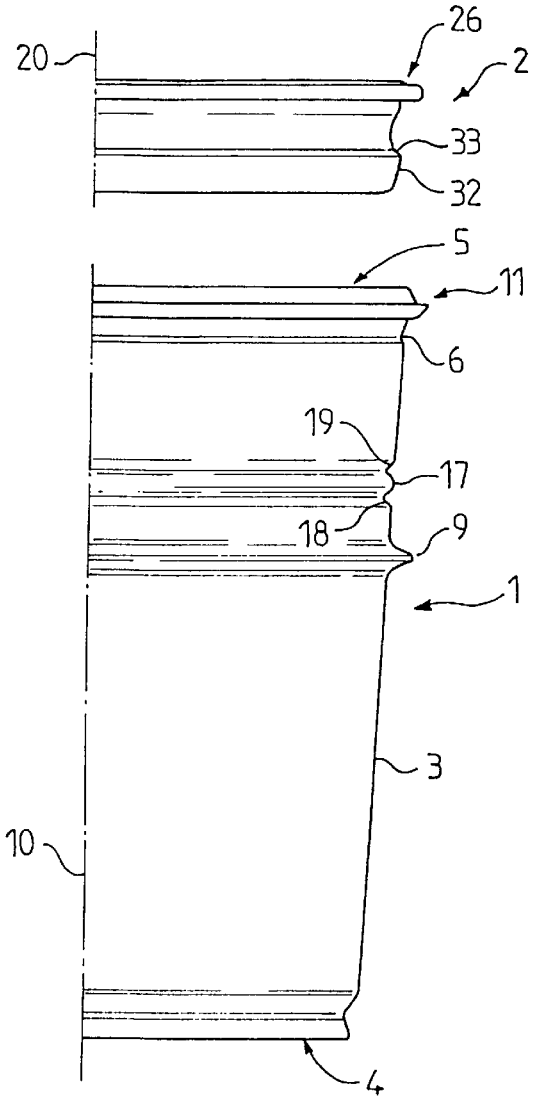
FIG. 1 represents a front half-view of a packing according to the invention, whereby the lid and the container are separate.

On FIG. 1, reference 1 indicates the container of the packing according to the invention and reference 2, its lid.

The container 1 is classically denominated 'truck can'. It consists of a hollow body 3, here slightly truncated in shape, making up the wall of the container. It is closed at one of its ends by a crimped bottom 4 and exhibiting at its other end an opening 5 designed for accommodating the lid 2. In the example illustrated on the figures, it is a total opening.

The container 1 of the packing according to the invention can be made from a traditional truck can.

However, during manufacture, the gasket conventionally arranged between the bottom 4 and the hollow body 3, is left out, when the container is designed for being heated to relatively high temperatures.

This enables to suppress a component, which might emit ill-smelling gases. The container 1 exhibits a groove 6 to enable latching of the lid 2.

Figure 5:
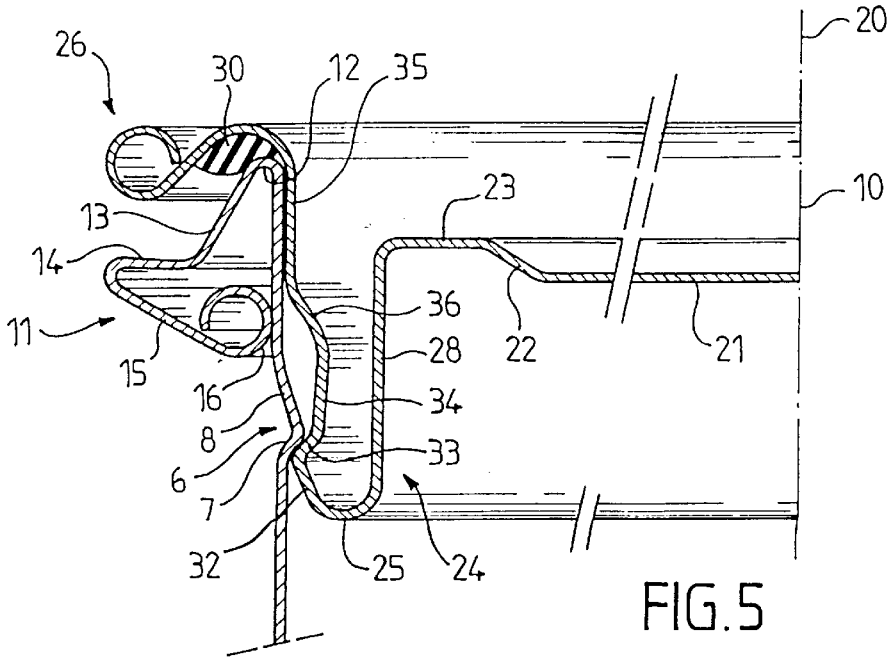
FIG. 5 is an enlarged view of detail A of FIG. 1.

With reference to FIG. 5, this groove comprises two truncated faces 7 and 8, aligned with respect to one another. The face 7 is the one closer to the bottom 4. It delineates a snap ring and constitutes a bearing face.

The face 8 is a connection element between the bearing face 7 and the upper part of the container 1 delineating the opening 5.

Thus, the face 7 is converging with respect to the axis of symmetry 10 of the container 1, while the face 8 is diverging with respect to this same axis.

The upper part of the container is prolonged by a rim 11 cantilevered outside the container and produced by rolling the wall of the container.

This rim 11 surrounds the container and exhibits a concave area 12, whose concavity is turned to the bottom 4 of the container. This concave zone forms a rib linking the circumference of the opening 5 at a truncated part 13 which is diverging with respect to the axis of symmetry 10 of the container. This area itself is prolonged by a portion 14 more or less parallel to the bottom, then by a return wall 15. A rolled section 16 in contact with the external wall of the container 1 terminates the latter.

The container 1 also exhibits a snap ring 9 enabling to separate the piled up containers easily.

Between the groove 6 and the snap ring 9, the container 1 comprises another snap ring 17 defined between two truncated portions 18 and 19.

The truncated portion 18, closest to the bottom, is converging with respect to the axis of symmetry 10 of the container, whereas the truncated portion 19 is diverging with respect to this same axis.

The snap ring 17 is used for latching the internal wall 40, as will be described later.

Figure 3:
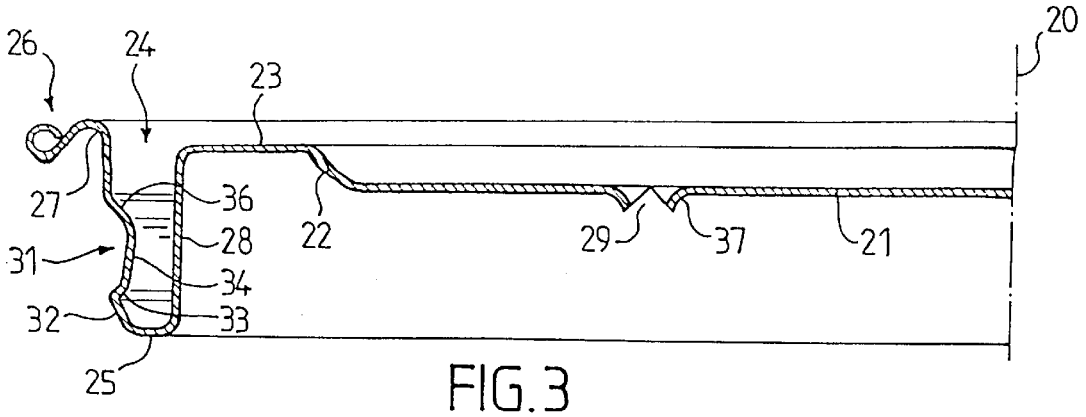
FIG. 3 is a half-view of the lid of the packing according to the invention, along its axis of symmetry.

With reference also to FIG. 3, the lid 2 exhibits, from its axis of symmetry 20, a center portion 21, followed by the shoulder 22 prolonged by a plane and annular peripheral part 23. This peripheral part 23 is further from the bottom 4 than the center part 21, when the lid 2 is placed on the container 1. The axes 10 and 20 then coincide, as shown on FIG. 5.

The peripheral part 23 is connected to a retaining skirt 24 extending on the external circumference of the lid 2. This skirt is designed for nesting into the opening 5 of the container, whereas the lid is of the 'inward' type.

This skirt 24 exhibits the general shape of a groove having a bottom 25.

A rolled-up rim 26 prolongs the groove. The rim is cantilevered externally with respect to the groove.

The groove defines a throat 27. As can be seen later in the description, a padding 30 made of a material enabling to fasten the lid and the container under the effect of temperature, can advantageously be placed in this throat.

The throat 27 or the padding co-operates with the concave area 12 linking the rim 11 to the outline of the opening 5 when the lid is pushed into the container.

The groove consists of a cylindrical wall 28 linking the bottom 25 of the groove to the peripheral part 23 and of a formed wall 31 linking the bottom 25 of the groove to the rim 26.

This wall 31 comprises essentially a portion 32 diverging with respect to the axis of symmetry 20 of the lid, followed by a portion 33 converging with respect to the same axis, then a portion 34 slightly converging and portion 35 more or less cylindrical, whereby both these portions are connected by a truncated portion 36, flaring up from the portion 34;

The converging portion 33 makes up a bearing surface and delineates a snap ring designed for co-operating with the bearing face 7 of the container, which also forms a snap ring.

When the packing system is designed for being heated, the lid 2 also exhibits at least one hole 29. To facilitate the manufacture, the hole can simply look as being 'punctured', whereas the metal burrs referred to 37 are not removed.

Advantageously, a filter can be fixed on the internal face of the lid 1, inside the space delineated by the cylindrical wall 28. This filter is of interest when heating the packing at high temperatures, whereby this heating procedure causes gaseous emanations through the holes 29.

Figure 4:
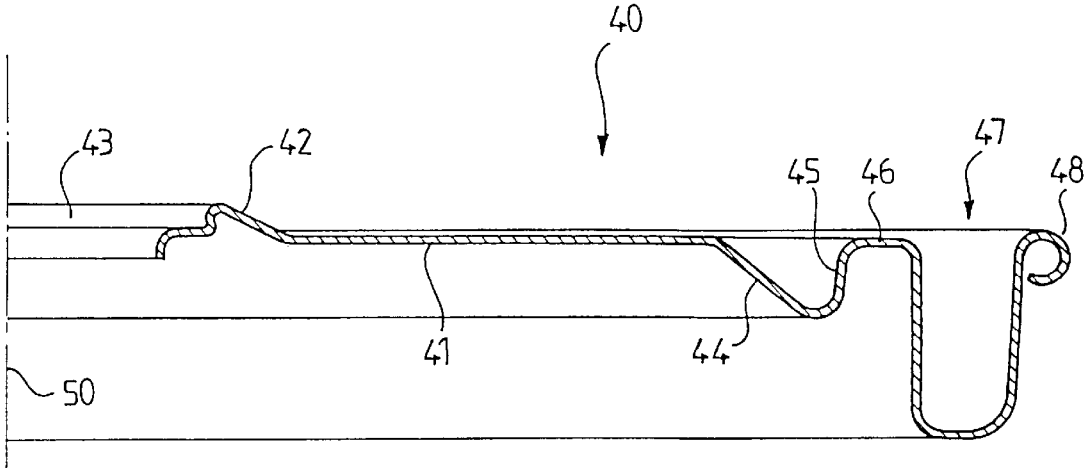
FIG. 4 is a semi-sectional view of the internal wall of the packing according to the invention, along its axis of symmetry

We shall now refer to FIG. 4 which illustrates the internal wall 40.

The wall 40 comprises, centered on its axis of symmetry 50, a center part 41.

The latter exhibits a crank 42 cantilever extending around a center orifice 43. It is through this orifice that the materials to be disposed of can be inserted. Other orifices can also be arranged.

This orifice is designed to be closed by appropriate means which are not illustrated on FIG. 4 and which bear upon the crank 42. These means are removable or retractable.

The internal wall or partition 40 then comprises, from the center part 41 and while moving away from the axis of symmetry 50, a truncated wall 44 flaring from the axis 50 and on the side opposite to the center part 41, with respect to the crank 42.

A cylindrical wall 45 which comes back more or less to the level of the center part 41 prolongs the truncated wall.

A concave area 46, whose concavity is turned to the bottom 4 of the container, when the internal partition is fixed to the container, prolongs the cylindrical wall.

The concave area 46 is prolonged by a skirt 47 which has more or less the shape of a groove, extends with respect to the center part 41, on the side opposite to the crank 42 and is terminated by a rolled rim 48.

The internal partition 40 is latched in position inside the container. The rolled rim 48 is inserted forcibly into the snap ring 17. The internal partition 40 cannot be removed any more, whereby the truncated portion 19 prevents any upward movement. The internal partition cannot be pushed forward any farther into the container, because of the truncated portion 18.

The internal partition 40 defines, with the bottom 4 and the wall 3 of the container, a receptacle 60 to accommodate the materials to be disposed of.

In the described embodiment, the internal partition is more or less parallel to the bottom 4 of the container. The invention is not limited to this embodiment. The main thing is that the receptacle provided in the container is closed, whereas the sole openings are those arranged in the partition properly speaking. Especially, the internal partition is not perpendicular to the bottom of the container.

The packing according to the invention is used as follows:

As the opening 5 of the container is free from any lids, the disposable materials are placed gradually in the receptacle 60, thanks to the passage provided by the orifice 43 in the internal partition.

When the receptacle 60 is full, the orifice 43 is closed by appropriate means.

The lid is then positioned on the container 1 and pushed into the opening 5.

During a first sealing operation, the lid is lowered easily into the container. There is no contact point between the lid and the container, since the portions 32, 33, 34 and 36 are recessed with respect to the internal surface of the container.

The air inside the container and compressed by the lowered lid can flow readily to the outside of the container.

In a second sealing operation, the snap ring 33 comes into contact with the truncated face 8 then latches into the snap ring 7. However, the air volume trapped between the internal partition 40 and the lid 2 is reduced. The pressure inside the container is thus sufficiently low to prevent the container from opening accidentally with the lid being ejected.

Moreover, the air may escape through the holes 29 when they are provided in the lid.

The container 1 is then closed and can be eliminated together with the household refuse.

Means enabling fastening the lid on the container can also be provided.

Means consisting of an additional element can also be contemplated, for instance such as an external ring placed at the level of the link between the lid and the container, and held in tight position.

Other embodiments are more particularly suited to packing systems designed for sterilization.

In such a case, a padding 30 of a material ensuring fastening under the effect of temperature, in the throat 27 of the lid, as illustrated on FIG. 5, is provided.

In order to be sterilized, the packing is placed in a furnace of appropriate sizes.

The furnace heats up the container, at a temperature and for duration sufficient to sterilize the disposable materials placed inside the receptacle 60.

For instance, the container can be heated for one hour, at a temperature of 260° C.

During the heating phase, gases can be generated inside the container. They may escape thanks to the holes 29 provided in the lid. Moreover, these gases are filtered thanks to the filter arranged on the lid.

Upon completion of the heating phase, the packing is removed from the furnace and it is left to cool down.

The matter 30 placed between the lid and container ensures definitive closing of the container by the lid, whereas the latter cannot be removed any longer using a conventional tool.

The packing can then be disposed of directly together with the household refuse, since the risks of this packing opening accidentally have been practically suppressed.

This matter can consist of, for example, a welding material, such as tin or glue.

This glue is advantageously of the thermoplastic type. Thus, the gasket which is conventionally provided between the lid and the container is replaced with glue padding, applied in hot condition in the throat 27 of the rim 26 of the lid 2. The glue softens while the container is heated and hardens when the container cools down.

This matter may also consist of duroplastic glue which reacts during the heating phase.

As indicated previously, the embodiments of the container, of the lid and of the internal wall are not limited to the examples, which have just been described. Especially, the means enabling to close the container by the lid are similar to those which were described in the document FR-2 669 896, whose contents is included in this application. However, other means can be contemplated.

The container may notably be shaped as a 'truck can', but any other shape can be adopted as well.

The capacity of the container must be suited to the later usage of the packing according to the invention.

The reference signs inserted after the technical data mentioned in the claims solely at facilitating the understanding of the latter and do not limit their scope.

What is claimed is:

1. A sheet metal packing for disposable materials, comprising:

a container having a wall, a bottom, and an opening;

a lid to close the opening;

means for fastening the lid to the container, said means for fastening the lid comprising a padding placed on a rim of the lid and designed for contacting the container;

an internal partition removably fixed inside the container by a first snap ring for latching the internal partition on the container, said partition delineating, with the bottom and the wall of the container, a receptacle for said materials; and at least one orifice arranged in said partition for allowing passage of the materials in the receptacle.

2. The sheet metal packing according to claim 1, wherein the internal partition is substantially parallel to the bottom of the container.

3. The sheet metal packing according to claim 1, wherein the container comprises a second snap ring for latching the lid on the container.

4. The sheet metal packing according to claim 1, wherein the lid comprises, on its external circumference, a skirt designed for nesting into the opening of the container.

5. The sheet metal packing according to claim 1, wherein the orifice provided in the internal partition is closed by removable and retractable means.

6. The sheet metal packing according to claim 1, wherein the padding is made of thermoplastic glue.

7. The sheet metal packing according to claim 6, wherein the lid comprises a rolled-up rim delineating a throat for the thermoplastic glue.

8. The sheet metal packing according to claim 6, wherein the lid comprises at least one hole formed in order to allow, when heating the packing, the release of gases.

* * * * *